US009926772B2

(12) United States Patent
Allen et al.

(10) Patent No.: US 9,926,772 B2
(45) Date of Patent: Mar. 27, 2018

(54) APPARATUS AND METHODS FOR SELECTIVELY TREATING PRODUCTION ZONES

(71) Applicants: Jason A. Allen, Houston, TX (US); Aaron C. Hammer, Houston, TX (US); Robert S. O'Brien, Katy, TX (US)

(72) Inventors: Jason A. Allen, Houston, TX (US); Aaron C. Hammer, Houston, TX (US); Robert S. O'Brien, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 726 days.

(21) Appl. No.: 14/487,918

(22) Filed: Sep. 16, 2014

(65) Prior Publication Data

US 2015/0075807 A1 Mar. 19, 2015

Related U.S. Application Data

(63) Continuation-in-part of application No. 14/201,394, filed on Mar. 7, 2014, now Pat. No. 9,574,408.
(Continued)

(51) Int. Cl.
*E21B 43/14* (2006.01)
*E21B 33/124* (2006.01)
*E21B 43/26* (2006.01)

(52) U.S. Cl.
CPC ..... *E21B 43/14* (2013.01); *E21B 33/124* (2013.01); *E21B 43/26* (2013.01)

(58) Field of Classification Search
CPC ..... E21B 43/162; E21B 43/14
See application file for complete search history.

(56) References Cited

U.S. PATENT DOCUMENTS 80,875 A 8/1868 Platt et al.
85,428 A 12/1868 Burditt et al.
(Continued)

FOREIGN PATENT DOCUMENTS

EP 1001132 A2 5/2000
WO 0026501 A1 5/2000
(Continued)

OTHER PUBLICATIONS

PCT International Search Report and Written Opinion; International Application No. PCT/US2015/014607; International Filing Date: Feb. 5, 2015; dated May 19, 2015; pp. 1-10.
(Continued)

*Primary Examiner* — Robert E Fuller
(74) *Attorney, Agent, or Firm* — Cantor Colburn LLP

(57) ABSTRACT

In one aspect, an apparatus for selectively treating a plurality of zones around wellbore is disclosed that in one non-limiting embodiment includes an outer string for placement in the wellbore, the outer string including a packer above a flow port corresponding to each zone, wherein each packer is configured to be set independently and the flow port is configured to supply a treatment fluid to its corresponding zone when such flow port is open, an activation device coupled to each packer, wherein each such activation device is configured to be independently activated to set its corresponding isolation packer, and an inner string for placement in the outer string, the inner string including a frac port for supplying a fluid under pressure to each flow port.

22 Claims, 5 Drawing Sheets

Related U.S. Application Data

(60) Provisional application No. 61/878,383, filed on Sep. 16, 2013, provisional application No. 61/878,357, filed on Sep. 16, 2013, provisional application No. 61/878,341, filed on Sep. 16, 2013.

(56) References Cited

U.S. PATENT DOCUMENTS

| | | | |
|---|---|---|---|
| 1,342,813 | A | 6/1920 | Huston |
| 3,025,914 | A | 3/1962 | Fether |
| 3,133,595 | A | 5/1964 | Loughney et al. |
| 3,504,936 | A | 4/1970 | Brown et al. |
| 3,726,546 | A | 4/1973 | Brown |
| 4,125,129 | A | 11/1978 | Baumann |
| 4,176,717 | A | 12/1979 | Hix |
| 4,267,045 | A | 5/1981 | Hoof |
| 4,281,858 | A | 8/1981 | Bower |
| 4,369,840 | A | 1/1983 | Szarka et al. |
| 4,423,889 | A | 1/1984 | Weise |
| 4,778,008 | A | 10/1988 | Gonzalez et al. |
| 4,840,229 | A | 6/1989 | Proctor et al. |
| 5,122,271 | A | 6/1992 | Simon et al. |
| 5,341,880 | A | 8/1994 | Thorstensen |
| 5,769,122 | A | 6/1998 | Baumann et al. |
| 5,823,264 | A | 10/1998 | Ringgenberg |
| 6,003,607 | A | 12/1999 | Hagen et al. |
| 6,367,552 | B1 | 4/2002 | Scott et al. |
| 6,382,319 | B1 | 5/2002 | Hill, Jr. et al. |
| 6,447,021 | B1 | 9/2002 | Haynes |
| 6,978,840 | B2 | 12/2005 | Henderson |
| 7,055,598 | B2 | 6/2006 | Ross et al. |
| 7,086,479 | B2 | 8/2006 | Schultz et al. |
| 7,578,343 | B2 | 8/2009 | Augustine |
| 7,673,678 | B2 | 3/2010 | MacDougall et al. |
| 8,061,430 | B2 | 11/2011 | Du et al. |
| 8,220,555 | B1 | 7/2012 | Wintill et al. |
| 8,286,701 | B2 | 10/2012 | Schultz et al. |
| 8,403,061 | B2 | 3/2013 | Russell et al. |
| 8,403,064 | B2 | 3/2013 | Allen |
| 8,424,609 | B2 | 4/2013 | Duphorne et al. |
| 2002/0092653 | A1 | 7/2002 | Scott et al. |
| 2002/0117301 | A1* | 8/2002 | Womble ..... E21B 43/045 166/278 |
| 2003/0029621 | A1 | 2/2003 | Haynes |
| 2003/0141059 | A1 | 7/2003 | Mauldin et al. |
| 2003/0188894 | A1 | 10/2003 | Sunde et al. |
| 2005/0039916 | A1 | 2/2005 | Schultz et al. |
| 2006/0027377 | A1 | 2/2006 | Schoonderbeek et al. |
| 2006/0260818 | A1 | 11/2006 | Meijer et al. |
| 2007/0131434 | A1 | 6/2007 | MacDougall et al. |
| 2009/0133874 | A1 | 5/2009 | Dale et al. |
| 2010/0163250 | A1 | 7/2010 | Schultz et al. |
| 2010/0224375 | A1 | 9/2010 | Du et al. |
| 2010/0252250 | A1 | 10/2010 | Fripp et al. |
| 2011/0048706 | A1 | 3/2011 | Clem et al. |
| 2011/0079396 | A1 | 4/2011 | Russell et al. |
| 2011/0127047 | A1 | 6/2011 | Themig et al. |
| 2011/0146988 | A1 | 6/2011 | McGlothen |
| 2011/0186286 | A1 | 8/2011 | Allen |
| 2011/0209873 | A1 | 9/2011 | Stout |
| 2011/0226481 | A1 | 9/2011 | Duphorne et al. |
| 2011/0278017 | A1 | 11/2011 | Themig et al. |
| 2012/0085548 | A1 | 4/2012 | Fleckenstein et al. |
| 2013/0108356 | A1 | 5/2013 | Stautzenberger et al. |
| 2013/0112410 | A1 | 5/2013 | Szarka et al. |
| 2013/0199799 | A1 | 8/2013 | Phan et al. |
| 2014/0166312 | A1 | 6/2014 | Richards et al. |
| 2015/0252628 | A1 | 9/2015 | Cochran et al. |
| 2015/0375144 | A1 | 12/2015 | Greci |
| 2016/0069145 | A1 | 3/2016 | McGuire et al. |
| 2016/0084018 | A1 | 3/2016 | Allen |
| 2016/0123093 | A1 | 5/2016 | Richards et al. |

FOREIGN PATENT DOCUMENTS

| | | | |
|---|---|---|---|
| WO | 2007078375 | A2 | 7/2007 |
| WO | 2012162792 | | 12/2012 |
| WO | WO2012162792 | A1 | 12/2012 |

OTHER PUBLICATIONS

PCT International Search Report and Written Opinion; International Application No. PCT/US2015/017515; International Filing Date: Feb. 25, 2015; dated Jun. 8, 2015; 16 pages.

PCT International Search Report and Written Opinion; International Application No. PCT/US2014/055889; International Filing Date: Sep. 16, 2014; dated Dec. 23, 2014; pp. 1-10.

PCT International Search Report and Written Opinion; International Application No. PCT/US2014/055886; International Filing Date: Sep. 16, 2014; dated Dec. 19, 2014; pp. 1-9.

PCT International Search Report and Written Opinion; International Application No. PCT/US2014/055887; International Filing Date: Sep. 16, 2014; dated Dec. 18, 2014; pp. 1-10.

* cited by examiner

APPARATUS AND METHODS FOR SELECTIVELY TREATING PRODUCTION ZONES

CROSS-REFERENCE TO RELATED APPLICATIONS

This application takes priority from U.S. Provisional Patent Application Ser. No. 61/878,383, filed one Sep. 16, 2013; U.S. Patent Application Ser. No. 61/878,357, filed on Sep. 16, 2013; U.S. Provisional Application Ser. No. 61/878,341, filed on Sep. 16, 2013; and U.S. patent application Ser. No. 14/201,394, filed on Mar. 7, 2014, each assigned to the assignee of the present application and each of which is incorporated herein in its entirety by reference.

BACKGROUND

1. Field of the Disclosure

This disclosure relates generally to apparatus and methods for completing a wellbore for the production of hydrocarbons from subsurface formations, including fracturing selected formation zones in a wellbore, packing sand between the formation zones and casing in the wellbore and deploying a production string in the wellbore for the production of the hydrocarbons.

2. Background of the Art

Wellbores or wells are drilled in subsurface formations for the production of hydrocarbons (oil and gas). Modern wells can extend to great well depths, often more than 1500 meters. Hydrocarbons are trapped in various traps in the subsurface formations at different depths. Such sections of the formation are referred to as reservoirs or hydrocarbon-bearing formations or zones. Some formations have high mobility, which is a measure of the ease of the hydrocarbons flow from the reservoir into a well drilled through the reservoir under natural downhole pressures. Some formations have low mobility and the hydrocarbons trapped therein are unable to move with ease from the reservoir into the well. Stimulation methods are typically employed to improve the mobility of the hydrocarbons through the reservoirs. One such method, referred to as fracturing and packing (also referred to as "frac/pack"), is often utilized to create cracks in the rock in the reservoir and pack it with sand to enable the fluid from the formation (formation fluid) to flow from the reservoir into the wellbore. To frac/pack multiple zones, an assembly containing an outer string with an inner string therein is run in or deployed in the wellbore. The outer string is conveyed in the wellbore with a tubing (pipe) attached to its upper end and it includes various devices corresponding to each zone to be fractured for supplying a fluid with proppant to each such zone. The inner string includes devices attached to a tubing to operate certain devices in the outer string and facilitate fracturing and/or other well treatment operations. For selectively treating a zone in a multi-zone wellbore, it is desirable to have an inner sting that can be selectively set corresponding to any zone in a multi-zone well and perform a well operation at such selected zone.

The disclosure herein provides apparatus and methods for treating multiple zones along a wellbore and pack such zones with a proppant to enable efficient to flow of the fluid from the formation to a wellbore.

SUMMARY

In one aspect, an apparatus for selectively treating a plurality of zones around a wellbore is disclosed that in one non-limiting embodiment includes an outer string for placement in the wellbore, the outer string including a packer above a flow port corresponding to each zone, wherein each packer is configured to be set independently and the flow port is configured to supply a treatment fluid to its corresponding zone when such flow port is open, an activation device coupled to each packer, wherein each such activation device is configured to be independently activated to set its corresponding isolation packer, and an inner string for placement in the outer string, the inner string including a frac port for supplying a fluid under pressure to each flow port.

In another aspect, a method for selectively treating a plurality of zones around a wellbore is disclosed that in one non-limiting embodiment includes: placing an outer string in the wellbore, the outer string having a packer above a flow port corresponding to each zone, wherein each such packer is configured to be set independently and each such flow port is configured to supply a treatment fluid to its corresponding zone when such flow port is open; placing an inner string in the outer string, the inner string including a frac port for supplying the treatment fluid to the flow ports; selecting a zone from the plurality of zones for treatment; setting the packer corresponding to the selected zone without setting at least one other upper packer corresponding to another zone and opening the flow port associated with the selected zone; and supplying the treatment fluid to the flow port from the frac port to treat the selected zone.

Examples of the more important features of a well completion system and methods have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein.

DETAILED DESCRIPTION OF THE DRAWINGS

Figure 1:
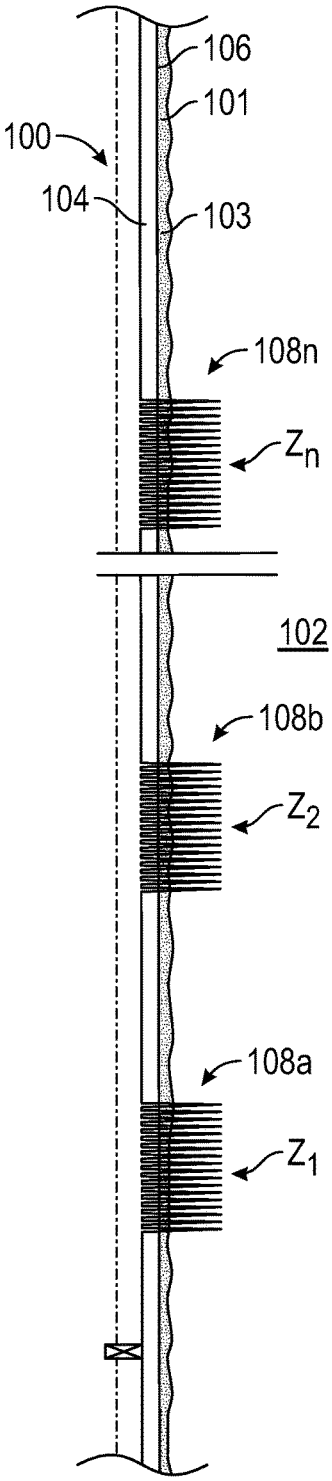
FIG. 1 is a line diagram of an exemplary cased multi-zone wellbore that has been configured for a treatment operation.

FIG. 1 is a line diagram of a wellbore system 100 that includes a wellbore 101 configured for a treatment operation, such as fracturing (also referred to herein as fracing or fracking) and gravel packing multiple zones. The wellbore 101 is formed in a subsurface formation 102. The wellbore 101 is lined with a casing 104, such as a string of jointed metal pipes sections, known in the art. The space or annulus 103 between the casing 104 and the wellbore 101 is filled with cement 106. The formation 102 has multiple zones Z1-Zn from which hydrocarbons may be produced. Each such zone is shown perforated with perforations that extend from the casing 104 into each zone through the cement 106. In FIG. 1, zone Z1 includes perforations 108*a*, zone Z2 includes perforations 108*b*, and zone Zn perforations 108*n*. A fracturing operation, according to a non-limiting embodiment, is described in reference to FIGS. 2-6.

Figure 2:
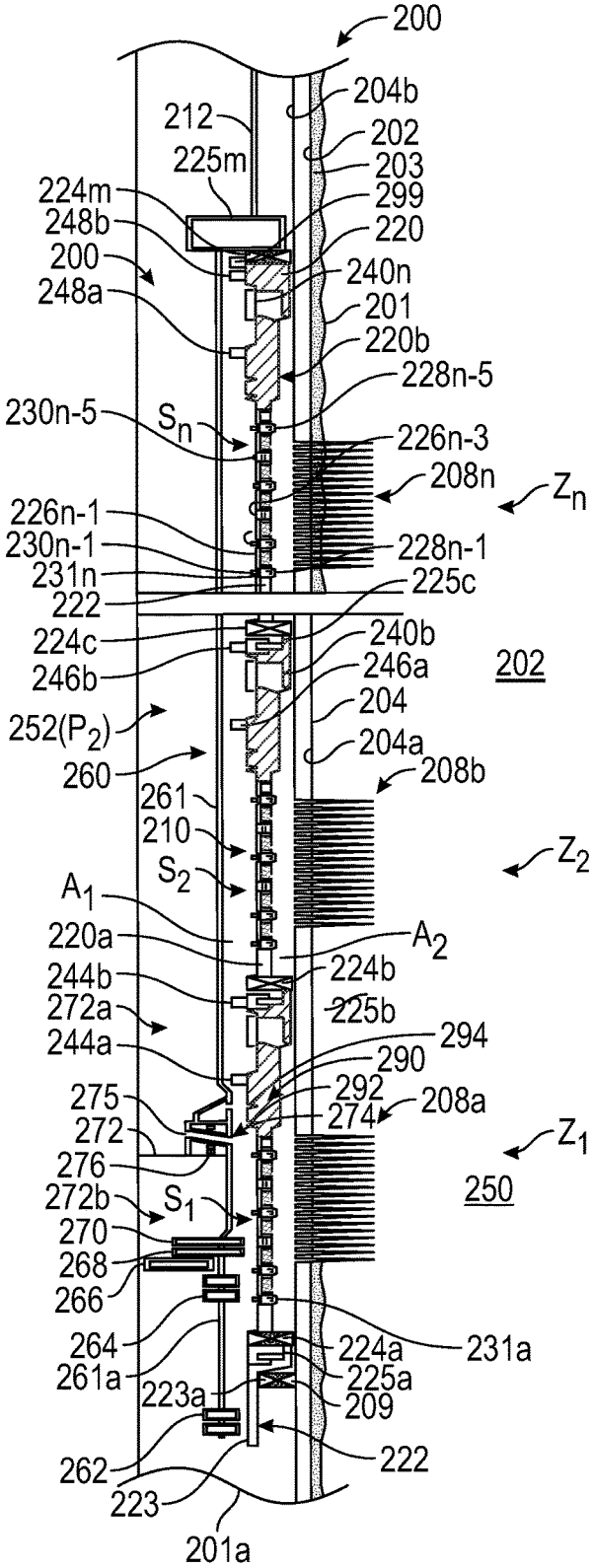
FIG. 2 is a line diagram of an exemplary wellbore system with a system assembly a treatment or service assembly run in a perforated multi-zone wellbore for treating the wellbore.

FIG. 2 is a line diagram of a wellbore system 200 for treating a wellbore 201, according to one non-limiting embodiment of this disclosure. The wellbore system 200 is shown configured to perform a fracturing and packing (frac/pack) operation, but it may be configured to perform other treatment or service operations, including, but not limited to, gravel packing and flooding a formation to move formation fluid toward a production well. The wellbore 201 is shown formed in a formation 202. The wellbore 201 is lined with a casing 204 and filled with cement 206 in the annulus 203 between the wellbore 201 and the outside 204*a* of the casing 204. The wellbore system 200 includes multiple perforated production zones Z1, Z2 . . . Zn having corresponding perforations 208*a*, 208*b* . . . 208*n* extending from the casing 204 into the formation 202. The perforations in each zone provide fluid passages for fracturing each such zone. The perforations also provide fluid passages for formation fluid 250 to flow from the formation 202 to the inside 204*b* of the casing 204. The wellbore 201 includes a sump packer 209 proximate to the bottom 201*a* of the wellbore 201. The sump packer 209 is typically deployed after installing casing 204 and cementing the wellbore 201. The sump packer 209 is tested to a pressure rating before treating the wellbore 201, such as fracturing and packing, which pressure rating may be below the expected pressures in the wellbore after a section has been treated and isolated, as described herein. After casing, cementing and sump packer deployment, the wellbore 201 is ready for treatment operations, such as fracturing and gravel packing of each of the production zones Z1-Zn. The formation fluid 250 is under formation pressure P1 and the wellbore 201 is filled with a fluid 252, such as completion fluid, which fluid provides hydrostatic pressure P2 in the wellbore. The hydrostatic pressure P2 is typically greater than the pressure P1 of the formation 202 along the depth of the wellbore 201, which prevents flow of the fluid 250 from the formation 202 into the casing 204, which prevents blowouts.

FIGS. 2-6 depict a process or method (or certain stages) of selectively frac-packing production zones Z1-Zn, according to one non-limiting embodiment of the disclosure. In one aspect, frac-packing may be performed sequentially starting with the bottom most (zone Z1). Referring back to FIG. 2, to fracture and pack each of the zones Z1 through Zn, a system assembly 210 is run inside the casing 204 by a conveying member 212, which may be a tubular made of jointed pipe section, known in the art. In one non-limiting embodiment, the system assembly 210 includes an outer string 220 and an inner string 260 placed inside the outer string 220. The outer string 220 includes a pipe 222 and a number of devices associated with each of the zones Z1-Zn for performing treatment operations described in detail below. In one non-limiting embodiment, the outer string 220 includes a seal 223*a* on the outside of the pipe 222 and proximate to a bottom end 223 of the outer string 220. The outer string 220 further includes a lower packer 224*a*, an uppermost or top packer 224*m* and intermediate packers 224*b*, 224*c*, etc. The lower packer 224*a* isolates the sump packer 209 from hydraulic pressure exerted in the outer string 220 during fracturing and sand packing of the production zones Z1-Zn and the pressure due to the production of fluid. In this case the number of packers in the outer string 220 is one more than the number of zones Z1-Zn. In some cases, the sump packer 209, however, may be utilized as the lower packer 224*a*. In open hole applications, packer 224*a* may be omitted. In one non-limiting embodiment, the intermediate packers 224*b*, 224*c*, etc. may be configured to be independently (or individually or separately) deployed in any desired order so as to selectively fracture and pack any of the zones Z1-Zn in any desired order. In another embodiment, some or all the packers may be configured to be deployed at the same or substantially at the same time. In one aspect, packers 224*a*-224*m* may be hydraulically set or deployed. In another aspect, packers 224*a*-224*m* may be mechanically set or deployed.

Still referring to FIG. 2, the outer string 220 further includes a screen assembly adjacent to each zone. For example, screen assembly S1 is shown placed adjacent to zone Z1, screen assembly S2 adjacent zone Z2 and screen assembly Sn adjacent to zone Zn. The lower packer 224*a* and intermediate or upper packer 224*b*, when deployed, will isolate zone Z1 from the remaining zones, packers 224*b* and 224*c* will isolate zone Z2 and packers 224*m*-1 and 224*m* will isolate zone Zn. In one non-limiting embodiment, each packer has an associated packer activation device, such as a valve or seals known in the art that allows selective deployment of its corresponding packer in any desired order. In FIG. 2, a packer activation device 225*a* is associated with the lower packer 224*a*, device 225*b* with intermediate packer 224*b*, and device 225*c* with intermediate packer 224*c*. In one aspect, packers 224*a*-224*m* may be hydraulically-activated packers. In one aspect, the lower packer 224*a* and the upper packer 224*m* may be activated at the same or substantially at the same time when a fluid under pressure is supplied into the pipe 212. In one non-limiting embodiment, the activation devices 225*b* and 225*c* respectively associated with the intermediate packers 224*b*, 224*c*, may include a balanced piston device that remains under a balanced pressure condition (also referred to herein as the "inactive mode") to prevent a pressure differential from building between the inside 220*a* and outside 220*b* of the outer sting 220 to activate the packer.

Still referring to FIG. 2, in one non-limiting embodiment, each of the screen assemblies S1-Sn may be made by serially connecting two or more screen sections with interconnecting connection members to form each such screen assembly of a desired length. In one aspect, the interconnections provide axial fluid communication between the adjacent screen sections. For example, screen assembly Sn is shown to include five (5) screen sections 226*n*-1, through 226*n*-5 interconnected by connections 228*n*-1, 228*n*-2 . . . 228*n*-5. Each connection 228*n*-1-228*n*-5 may include a flow communication device, such as a sliding sleeve valve or sleeve, to provide flow of the fluid 250 from the formation 202 into the outer string 220. Similarly, other screen assemblies may also include several screen sections and corresponding connection devices. The flow of the fluid along the screen or the wellbore is referred to herein as the "axial flow", while the flow between the formation 202 and casing inside 204*b* of the casing 204 is referred to as the "radial flow." FIG. 2 shows a flow control device or valve 230*n*-1 associated with the connection 228*n*-1 through device 230*n*-5 with connection 228*n*-5. In one aspect, each of the devices 230*n*-1-230*n*-5, when opened, provides radial fluid communication between the inside 220*a* of the outer string 220 and its corresponding zone. In one non-limiting configuration, each such flow control device may include a sliding sleeve or another mechanism that is in a closed position when the outer string 220 is run in the wellbore 201 and which sleeve can be opened in the wellbore 201 when desired to allow fluid 250 to flow from its corresponding zone to the inside 220*a* of the outer string 220. Thus, when the flow control devices 230*n*-1 through 230*n*-5 are open, they establish fluid communication between the formation 202 and the inside 220*a* of the outer string 220 via perforations 208*n*. A monitoring valve is provided at the lower end of each screen assembly, such as valve 231*a* for screen assembly S1 and valve 231-*n* for screen assembly Sn. Similarly, screen assemblies S1, S2 etc. may include multiple screen sections.

Still referring to FIG. 2, the outer string 220 also includes, for each zone, a flow control device or flow port, referred to as a slurry outlet or a gravel exit, such as a sliding sleeve valve or another valve, uphole or above its corresponding screen assembly to provide fluid communication between the inside 220*a* of the outer string 220 and each such zone. As shown in FIG. 2, a slurry outlet 240*a* is provided for zone Z1 between screen S1 and its intermediate packer 224*b*, slurry outlet 240*b* for zone Z2 and slurry outlet 240*n* for zone Zn. In FIG. 2, each of the devices 240*a*-240*n* is shown in the closed position so no fluid can flow from the inside 220*a* of the outer string 220 to any of the zones Z1-Zn, until opened downhole. In yet another aspect, the outer string 220 may further include an inverted seal below and another above each slurry outlet for performing the treatment operation, as described in more detail in reference to FIGS. 3-6. In FIG. 2, inverted seals 244*a* and 244*b* are shown associated with slurry outlet 240*a*, inverted seals 246*a* and 246*b* with the slurry outlet 240*b* and inverted seals 248*a* and 248*b* with slurry outlet 240*n*. Alternatively, seals may be provided in the inner string 260. In one aspect, inverted seals 244*a*, 244*b*, 246*a*, 246*b*, 248*a* and 248*b* may be configured so that they can be pushed into the outer string 220 or removed from the outer string 220 after completion of the treatment operations or during the deployment of a production string (not shown) for the production of hydrocarbons from wellbore 201. Pushing inverted seals inside 220*a* of the outer string 220 or removing such seals from the inside 220*a* of the outer string 220 provides increased inside diameter of the outer string 220 for the installation of a production string for zones Z1-Zn compared to an outer string having seals extending inside the outer string. In another aspect, seals 244*a*, 244*b*, 246*a*, 246*b*, 248*a* and 248*b* may be placed on the outside of the inner string 260 instead on the inside of the outer string 220.

Still referring to FIG. 2, the inner string 260 (also referred to herein as the service string) may include a metallic tubular member 261 that carries one or more opening shifting tools 262 and one or more closing shifting tools 264 along a lower end 261*a* of the inner string 260. The inner string 260 further may include a reversing valve 266, an up-strain locating tool or locating tool 268 below a set down 270. The locating tool 268 is used to positively locate a locating profile 290 for each zone and the set down tool 270 is used to set down the inner string 260 in the outer string 220 at a corresponding set down profile 292. The functions of such devices are described later in reference to FIGS. 4-6. The inner string 260 also includes a plug 272 above the set down 270, which prevents fluid communication between the space 272*a* above the plug 272 and space 272*b* below the plug 272. The inner string 260 further includes a crossover tool 274 (also referred to herein as the "frac port") for providing a fluid path 275 from the inner string 260 to the outer string 220. In one aspect the frac port 274 also includes flow passages 276 therethrough, which passages may be gun drilled through the frac port 274 to provide fluid communication between the space 272*b* below the frac port and the annulus $A_1$ between the inner string 260 and the outer string 220. In one embodiment, the passages 276 are sufficiently narrow so that that there is relatively small amount of fluid flow through such passages. The outer string 220 further includes an up-strain profile or locating profile 290 and a set down profile 292 corresponding to each zone. Alternatively, the locating profile 290 and the set down 292 profile may be a common profile.

In one aspect, the outer string 220 and the inner string 260 may be run in or deployed in the wellbore 201 together. In one aspect, a seal 299 may be activated between the inner string 260 and the outer string 220 before running the strings 220 and 260 into the wellbore 201. Any fluid 252 in the wellbore or circulated during the run in will flow from the frac port 274 to the surface via the annulus A1 between the outer string 220 and the casing 204. When the inner string 260 stabs into the sump packer 209, it seals the fluid path from the annulus A2 between the inner string 260 and the outer string 220, preventing the fluid to flow from the inner string 260 to the surface. The seal 299 and the seal provided by sump packer 209 isolates the fluid in the annulus A1 from the annulus A2. At this stage, the annulus $A_1$ is at the pressure of the fluid 252 supplied into the inner string 260 while the pressure in the annulus $A_2$ is the pressure due to the fluid column in annulus $A_2$ because the annulus $A_2$ is exposed to the surface. Thus, any pressure applied to the inner string 260 will create a differential pressure between the annulus A1 and annulus A2. In one aspect, a suitable pressure may be applied to create sufficient differential pressure between annulus A1 and A2 to cause any hydraulically-activated device, including, but not limited to, packers 224*a*-224*m* to set or activate. Alternatively, each of the packers 224*a*-224*m* may be individually set or activated as described later. These methods prevent dropping of a ball into the inner string 260 to isolate annulus A1 from annulus A2, as commonly practiced in prior art methods.

Figure 3:
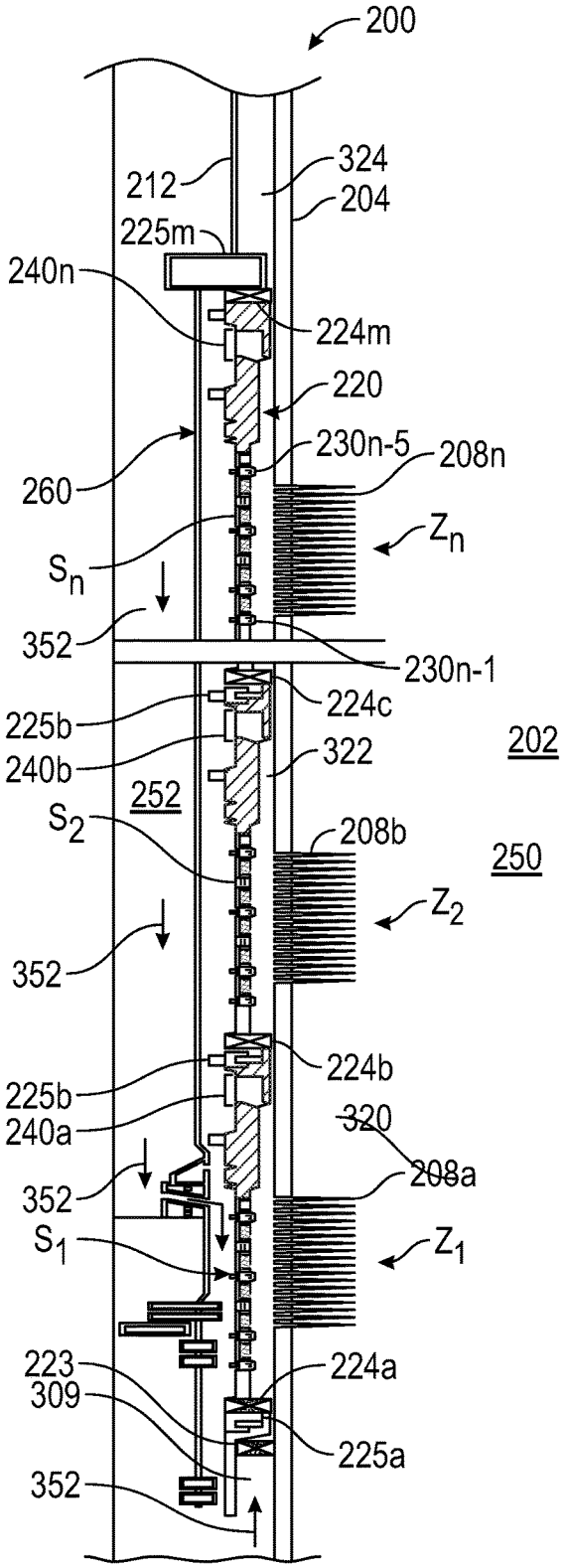
FIG. 3 shows the system of FIG. 2 configured to deploying an upper and a lower isolation device inside the casing.

An exemplary process or method of performing a treatment operation, such as fracturing and gravel packing, utilizing the inner string 260 deployed in the outer string 220, is described in reference to FIGS. 3-6. As shown in FIG. 3, the outer string 220 and the sump packer 209 are sealed by the seal 223, while packers 224*a* through 224*m*-1 are not deployed. Also valves 230*n*-1 through 230*n*-5 corresponding to screen S5 and similar valves corresponding to other screens, such as screens S2, S3, and slurry outlets 240*a*-240*n* are closed. The inner string 260 is shown at the bottom of the wellbore 201. At this stage, the well fluid 252 is present throughout the system 200 and thus the pressure at any location in the wellbore 201 is the hydrostatic pressure due to the column of the fluid 252 at that location, which pressure, as noted before, is greater than the pressure of the formation 202 at that location. Thus, the wellbore 201 is overburdened, which prevents the formation fluid 250 to flow from the formation 202 into the casing 204 via the perforations 208*a*-208*n*.

To start the treatment process, lower packer 224*a* and upper packer 224*m* are set or deployed. In case of hydraulically set packers, such as packers 224*a* and 224*m*, a fluid 352 under pressure is supplied into the tubular 212, which creates a pressure differential between the fluid in the annulus 324 and the fluid in the space 320 between the inner string 260 and the outer string 220 and the hydrostatic pressure in the annulus 324. To set upper or top packer 224*m* and the lower or bottom packer 224*a*, the pressure of the supplied fluid 352 is increased to a level that is sufficient to activate the packer activation devices 225*m* and 225*a*, which devices, in turn, hydraulically set their respective packers 224*m* and 224*a*. Setting the top 224*m* and lower packers 224*a*, anchors the outer string 220 inside the casing 204. In one aspect, setting the top packer 224*m* also may provide a sealed section or area 322 between the outer string 220 and the casing 204, which isolates the annulus 324 from the section 322. In another aspect, the top packer 224*m* may be utilized as an anchor only. In yet another aspect, an anchor device (not shown) may be positioned below the packer 224*m* that would allow the upper annulus 324 to be at the hydrostatic pressure. When the fluid 252 is supplied under pressure, intermediate packers 224*b* and 224*c* do not set or deploy because their respective packer activation devices 225*b* and 225*c* have not yet been activated, preventing from such packers from being deployed. Alternatively some or all packers may be deployed at the same time.

Figure 4:
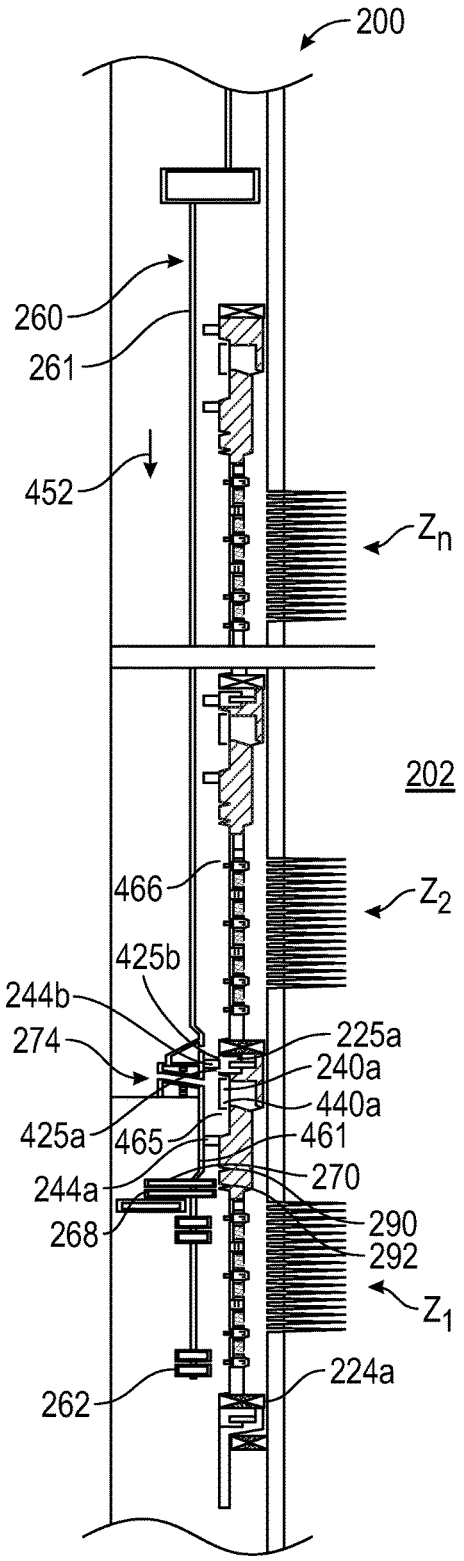
FIG. 4 shows the system of FIG. 3 configured to selectively set an isolation device.

FIG. 4 shows aspects of isolating and frac-packing the lower production zone Z1. To isolate zone Z1 from the remaining zones Z2-Zn, the inner string 260 is manipulated to cause the opening tool 262 to open the monitoring valve 231*a*. The inner string 260 may then be moved upward so that the locating tool 268 locates and engages with locating profile 290. The set down tool 270 is then set down in the set down profile 292 in the outer string 220. The profile on the locating tool 268 and the profile 290 may be uniquely configured so that the locating tool engages only with locating profiles 290 in the outer string. When the set down tool 268 is set down corresponding to zone Z1, the frac port 274 is adjacent to the slurry outlet 240*a*. The sleeve 440*a* of the slurry outlet 240*a*, however, remains closed. The pipe 261 of the inner string 260 has a sealing section 461 that comes in contact with the Inverted seals 244*a* and 244*b*, thereby isolating or sealing section 465 between the seals 244*a* and 244*b* that contains the slurry outlet 240*a* and the frac port 274, thus, providing fluid communication between the inner string 260 and the slurry outlet 240*a*. Sealing section 465 from section 466 allows the lower port 425*a* of the packer activation or setting device 225*b* (e.g. balanced piston device) to be exposed to the pressure in the section 465 while the upper port 425*b* is exposed to pressure in section 466. In this position, the activation device 225*b* is unbalanced and when a fluid under pressure is applied to the section 465, it will cause the packer 224*b* to set or be deployed, because the pressure in section 466 will now be the hydrostatic pressure, which pressure will be less than the applied pressure. Therefore, to set the packer 224*b*, fluid 452 under pressure is supplied into the inner string 260 sufficient to set the packer 224*b*. The above method provides for independently or individually setting any packer to independently isolate any zone in any sequence or order.

Referring back to FIG. 2, in one aspect, the locating tool 268 may be provided below the set down tool 270 to positively locate the selected profile 290 on the outer string 220, which can aid in setting the inner string 260 in the outer string 220 correctly. The locating tool 268 is configured to pass through the locating profiles 290 when moving downward, but engage with each such profile when the inner string 260 is moved upward. Thus, when the inner string 260 is moved upward from a location below the profile 290 in zone Z1, the locating tool 268 will engage with the profile 290 in zone Z1. The force required to further pull the locating tool 268 is sufficiently high to indicate to an operator that the locating tool 268 is at the selected locating profile. The inner string 260 is then moved downward to cause the set down tool 270 to set down in the set down profile 292. In an alternative embodiment, the locating tool profile and the set down tool profile may be configured so that such profiles engage with the profiles 290 and 292 respectively to the exclusion of any other profiles in the outer string 220.

Figure 5:
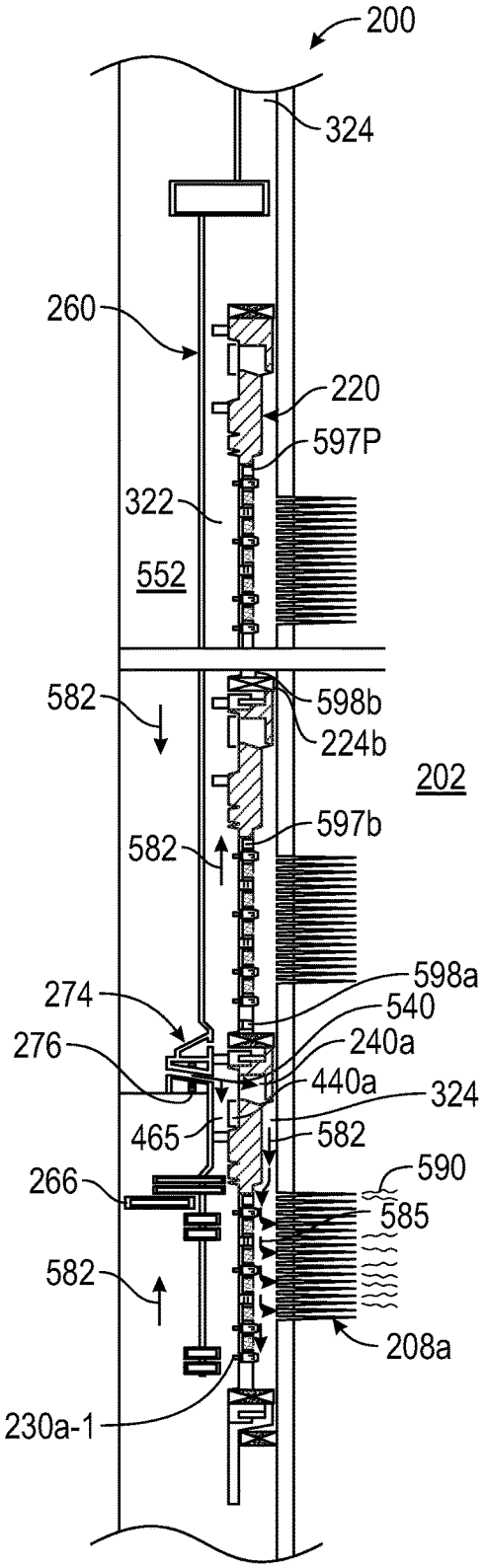
FIG. 5 shows the system of FIG. 4 configured to perform a treatment operation.

Referring now to FIG. 5, once the packer 224*b* has been set, it may be tested via the inner string 260. The frac sleeve 440*a* is then opened to allow fluid communication between inside of the inner string 260 and space 465 via the frac port 274. To fracture zone Z1, a fracing fluid 552, also referred to as slurry, is supplied under pressure into the inner string 260, which fluid travels to the perforations 208*a* via the frac port 274, fluid path 540 in the slurry outlet 240*a* and the space 585 between the outer string 220 and the casing 204 as shown by arrows 580. In one non-limiting embodiment, the fracing fluid or slurry 552 contains a base fluid, such as water, a proppant, such as sand particles or synthetic particles, and a material such as guar to cause the sand particle to suspend in the base fluid. The frac fluid 552 enters into the perforations 208*a* in the formation 202, creates fractures 590 in the zone Z1 and the proppant fills the fractures 590. After the fractures 590 have been sufficiently filled, the proppant starts to pack the area 585 between the screen S1 and the perforations 208*a*. During fracing (of the zone Z1) and packing (of the screen area 585), the monitoring valve 231*a* is opened and provides a return fluid flow path from the formation 202 to the space 322 between the outer string 220 and the casing 204 via gun drilled passages 276, because the reversing valve 266 is open. During fracing and packing, the annulus 324 is in fluid and, thus, in pressure communication with the fluid in the formation 202. The fluid 552 flowing from the surface through the inner string 260 experiences friction losses and thus the pressure applied by the fluid 552 to the formation is less than the surface pressure of the fluid 552. However, there is no significant friction loss in the fluid column in the annulus 324 because the flow rate through the passages 276 is relatively insignificant compared to the flow of the fluid 552 through the inner string 260. A pressure sensor (not shown) at the surface may be utilized to measure the pressure in the annulus 324, from which the pressure at the formation 202 may be calculated.

Figure 6:
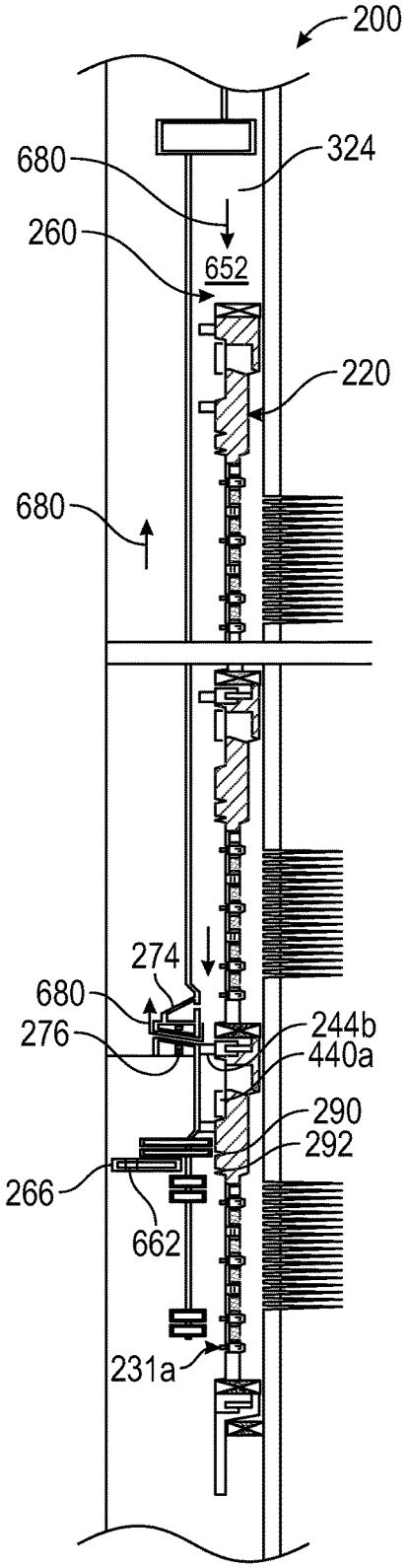
FIG. 6 shows the system of FIG. 5 configured to perform a reverse circulation operation to clean the work string after a treatment operation of the selected zone.

Referring now to FIG. 6, once zone Z1 has been fractured and the space 585 between the screen S1 and casing 204 has been packed with the proppant, a fluid 652 is pumped down the annulus 324 to the reversing valve 266 via the passages 276 to close the reversing valve 266. If the flow through the passages 276 is insufficient to close the reversing valve 266, the inner string 260 may be pulled up while pumping the fluid 652 to close the reversing valve 266. Closing the reversing valve 266 prevents any fluid from flowing past the reversing valve 266. The reversing valve, however, may include a weep hole 662 to prevent swabbing when the inner string is pulled upward. The inner string 260 is then pulled upward to cause the locating tool 268 to engage with or locate the locating profile 292. The frac port 274 is now above the seal 244*a*, which provides a fluid path between the annulus 324 and the inner string 260, as shown by arrows 680. The frac port 274 is now in the reverse flow position, i.e., the fluid can flow from the annulus 334 into the inner string 260. The inner string 260 remains in sealing contact with seal 244*b*, thereby preventing flow of any fluid from inner string 260 to the flow device 440*a*. Clean fluid 652 may now be supplied under pressure into the annulus 324 (reverse circulation) to remove the slurry from the inner string 260. The inner string 260 is then moved to close the monitoring valve 230*a* and the flow device 440*a* to prevent fluid communication between zone Z1 and the outer string 220. The integrity of the closed flow device 440*a* and the monitoring valve 230*a* may then be tested. The inner string 260 may then be moved upward to treating zone Z2 in the manner described above. Thus, in one aspect, the method described herein enables selectively or independently treating any zone in a multi-zone, i.e., in any order, although often it is desirable to treat zones in a sequential order starting with the lowermost zone, such as zone Z1. In another aspect, the packer activation devices, such as devices 225*a*-225*n*, may be configured to enable setting of some or all of the packers at the same or substantially at the same time.

At times the inner string 260 may become stuck in the wellbore 201 due to excessive presence or packing of the proppant. In such a situation it becomes necessary to remove at least the portion of the outer string above the stuck location from the wellbore. In one embodiment of the present system, the outer string 220 may further include an expansion joint with a disconnect or a disconnect alone above isolation packers above each upper isolation packer. In another embodiment another expansion joint may be provided below such isolation packer. In the embodiment of FIG. 5, an expansion joint 597*a* is provided below the isolation packer 224*b* and an expansion joint and disconnect 598*a* above the packer 224*b*. Similarly, an expansion joint 597*b* is provides below the isolation packer 224*c* and an expansion joint and disconnect 598*b* above the packer 224*c*. An expansion joint 297*p* is also shown below the top isolation packer 224*m*. In one aspect, each expansion joint and expansion joint and disconnect may be hydraulically armed and mechanically activated. An armed expansion joint does not move until activated by a secondary operation, such as by using the inner string to mechanically activate such expansion joint. When the expansion joint in the expansion joint and disconnect is pulled beyond its maximum expansion stroke, it disconnects from the outer string. In one aspect, all disconnects 598*a*-598*b* may be armed at the same time by a common pressure above a threshold in the inner string 260, but may be individually activated using the inner string 260, such as prior to treating a particular or selected zone. If for example the outer string is struck at the flow port 240 in the first zone Z1, it may desirable to retrieve the outer string 220 above the stuck point. In one scenario, all isolation packers 224*a*-224*m* would have been set and all expansion joints and disconnects 598*a*-598*b* armed hydraulically before the treatment of the zone Z1. The only expansion joint that would have been armed and activated would be the first expansion joint and disconnect 598*a*, while the remaining expansion joint and disconnects would be armed but not activated. In such case, the expansion joints in such inactive or deactivated expansion joints and disconnects would not move and thus not disconnect from the outer string when the outer string 220 is pulled upward. To disconnect the outer string, the inner string may be manipulated to mechanically disengage the upper packer 224*m*. The expansion joint and disconnect 598*a* may then be mechanically activated as it already has been armed. Then pulling the outer string 220 will cause the outer string at 260 to disconnect at the expansion joint and disconnect 598*a*, allowing the outer string 220 to be pulled out of the wellbore. Thus, in the system of FIG. 5, the outer string may be disconnected above any selected packer. As described earlier, a hydraulically armed and mechanically-activated disconnect device alone above each isolation packer to pull out the outer string, as described above. An example of an expansion joint and disconnect that may be utilized in the system described herein is disclosed in U.S. patent application Ser. No. 14/201,397, filed on Mar. 7, 2014, assigned to the assignee of this application, which is incorporated herein in entirety by reference.

The foregoing disclosure is directed to the certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A method of selectively treating a plurality of zones around a wellbore, the method comprising:

placing an outer string in the wellbore, the outer string having a packer above a flow port corresponding to each zone, wherein each such packer is configured to be set independently and each such flow port is configured to supply a treatment fluid to its corresponding zone when such flow port is open;

placing an inner string in the outer string, the inner string including a frac port for supplying the treatment fluid to the flow ports;

selecting a zone from the plurality of zones for treatment;

sealing a section between the inner string and outer string at a packer corresponding to the selected zone;

providing a fluid from the inner string into the sealed section via the frac port to provide a pressure differential at the packer corresponding to the selected zone to set the packer without setting at least one other upper packer corresponding to another zone;

opening the flow port associated with the selected zone; and supplying the treatment fluid to the flow port from the frac port to treat the selected zone.

2. The method of claim 1, wherein selecting a zone for treatment comprises:

locating the selected zone using a locating device in the inner string and a locating profile in the outer string; and setting the inner string in the outer string to align the frac port with the flow port corresponding to the selected zone.

3. The method of claim 1, wherein setting the packer corresponding to the selected zone comprises:

providing an activation device for each packer in the plurality of packers configured to set its corresponding packer, wherein the activation device is activated in the presence of a pressure differential; and for the activation device corresponding to the selected zone, exposing a port of the activation device to the sealed section and exposing another port of the activation device to a section at hydrostatic pressure; and providing the fluid from the inner string into the sealed section to produce an applied pressure greater than the hydrostatic pressure to activate the activation device for the selected zone to thereby set the packer for the selected zone.

4. The method of claim 3, wherein each activation device comprises a balanced piston device that remains under a balanced pressure condition until activated in the wellbore.

5. The method of claim 4, wherein the balanced piston device prevents building of a differential pressure around the activation device until armed.

6. The apparatus of claim 5 further comprising setting the activation device by one of: hydraulically, mechanically and electrically.

7. The method of claim 3, wherein each activation device is one of: (i) a part of an expansion joint and a disconnect device; and (ii) a stand-alone disconnect device.

8. The method of claim 1 further comprising providing a disconnect device above each packer for disconnecting the outer string, wherein each such disconnect is configured to be independently activated.

9. The method of claim 8 further comprising:

hydraulically arming each disconnect device by supplying a fluid under pressure to the wellbore;

activating the disconnect device above a selected packer; and pulling the outer string from the activated disconnect device.

10. The method of claim 1 further comprising running into the wellbore the inner string and the outer string together with a seal between the inner string and outer string to isolate a first annulus between the inner string and outer string and a second annulus between the outer string and the wellbore.

11. The method of claim 10 further comprising;

setting a bottom end of the outer string in a packer to isolate the first annulus from the second annulus;

pressurizing the first annulus to hydraulically arm or activate one or more devices in the outer string.

12. The method of claim 1 further comprising:

providing a pair of inverted seals on the outer string or a pair of seals on the outside of the inner string to seal a section of an annulus between the inner string and the outer string to perform an operation in the wellbore.

13. An apparatus for selectively treating a plurality of zones around wellbore, the apparatus comprising:

an outer string for placement in the wellbore, the outer string including a packer above a flow port corresponding to each zone, wherein each packer is configured to be set independently and the flow port is configured to supply a treatment fluid to its corresponding zone when such flow port is open;

an activation device coupled to each packer, wherein each such activation device is configured to be independently activated by a pressure differential created at the activation device to set its corresponding isolation packer; and an inner string for placement in the outer string, the inner string including a frac port for supplying a fluid under pressure to each flow port, wherein supplying the fluid under pressure at a selected flow port creates the pressure differential for its corresponding activation device to set its corresponding isolation packer.

14. The apparatus of claim 13, wherein each activation device includes a balanced piston device that remains under a balanced pressure condition until activated in the wellbore.

15. The apparatus of claim 14, wherein the balanced piston device prevents building of a differential pressure around the activation device until armed.

16. The apparatus of claim 15, wherein each activation device is configured to be activated by one of: hydraulically, mechanically and electrically.

17. The apparatus of claim 13 further comprising a disconnect device above each packer for disconnecting the outer string and configured to be independently activated to set its corresponding packer.

18. The apparatus of claim 17, wherein each disconnect device is configured to be hydraulically armed and mechanically activated.

19. The apparatus of claim 17, wherein each disconnect device is one of: (i) a part of a common expansion joint and a disconnect device; and (ii) a stand-alone disconnect device.

20. The apparatus of claim 13, wherein the inner string and the outer string are configured to be run into the wellbore together with a seal between the inner string and outer sting to isolate a first annulus between the inner string and the outer string and a second annulus between the outer string and the wellbore.

21. The apparatus of claim 13 further comprising a pair of one of inverted seals on the outer string and a pair of seals on outside of the inner string to seal a section of an annulus between the inner string and the outer string to perform an operation in the wellbore.

22. The apparatus of claim 13 further comprising:

a locating profile on the outer string corresponding to each zone; and a locating device in the inner string having a locating profile configured to engage with each locating file on the outer string when the inner string is moved upward to the exclusion of any other profile on the outer string.

* * * * *